US005716536A

United States Patent [19]

Yokoto et al.

[11] Patent Number: 5,716,536

[45] Date of Patent: Feb. 10, 1998

[54] PLANAR HEATING DEVICE FOR USE WITH MIRRORS

[75] Inventors: Shigenori Yokoto, Ebina; Hiroshi Yamaguchi, Sagamihara; Mitsunori Tsukamoto; Shunichi Morii, both of Hachioji; Kouji Fukuda, Yamato, all of Japan

[73] Assignee: Tokyo Cosmos Electric Co. Ltd., Tokyo, Japan

[21] Appl. No.: 787,603

[22] Filed: Jan. 23, 1997

Related U.S. Application Data

[62] Division of Ser. No. 567,772, Dec. 5, 1995, abandoned.

[30] Foreign Application Priority Data

Dec. 7, 1994 [JP] Japan ..... 6-303933
Sep. 4, 1995 [JP] Japan ..... 7-226691

[51] Int. Cl.[6] ..... H05B 3/00

[52] U.S. Cl. ..... 219/219; 219/203; 219/522; 219/528; 15/250.003; 338/306

[58] Field of Search ..... 219/202–203, 219/219, 522, 528, 536, 542, 544, 548–549; 359/507, 838, 841; 15/250.003; 338/254, 306

[56] References Cited

U.S. PATENT DOCUMENTS

| | | | |
|---|---|---|---|
| 3,813,519 | 5/1974 | Jochim et al. | 219/522 |
| 3,995,142 | 11/1976 | Ciardelli et al. | 219/203 |
| 4,023,008 | 5/1977 | Durussel | 219/203 |
| 4,034,207 | 7/1977 | Tamada et al. | 219/553 |
| 4,415,196 | 11/1983 | Baum et al. | 219/203 |
| 4,628,187 | 12/1986 | Sekiguchi et al. | 219/548 |
| 4,725,710 | 2/1988 | Ramus et al. | 219/203 |
| 4,743,741 | 5/1988 | Ramus | 219/203 |
| 4,857,711 | 8/1989 | Watts | 219/219 |
| 4,931,627 | 6/1990 | Watts | 219/203 |
| 4,977,309 | 12/1990 | Uchida | 219/543 |
| 5,015,824 | 5/1991 | Monter et al. | 219/219 |
| 5,132,840 | 7/1992 | Okada et al. | 219/219 |
| 5,155,625 | 10/1992 | Komatsu et al. | 219/219 |
| 5,198,639 | 3/1993 | Smuckler | 219/219 |

FOREIGN PATENT DOCUMENTS

| | | |
|---|---|---|
| 0 172 302 | 2/1986 | European Pat. Off. . |
| 0 340 361 | 11/1989 | European Pat. Off. . |
| 26 19 312 | 7/1977 | Germany . |
| 37 60 327 | 1/1988 | Germany . |
| 39 10 861 | 11/1989 | Germany . |

*Primary Examiner*—John A. Jeffery
*Attorney, Agent, or Firm*—Pollock, Vande Vande & Priddy

[57] ABSTRACT

Main electrodes 3, 4 are formed on the inner surface of a flexible insulating sheet 2 along opposed edges thereof, and junction electrode sections 3a, 4a are formed on the main electrodes at their central portions. Comb-toothed sub-electrodes 7, 8 extend from the main electrodes 3, 4 into interdigitated relation, and a layer of electrically resistive material 9 is formed over the main and sub-electrodes. Electrically conductive paths 5, 6 are formed on the inner surface of a terminal mounting substrate to which terminals are attached, and one ends of the conductive paths 5, 6 are connected with the corresponding junction electrode sections 3a, 4a while the other ends thereof are connected with the terminals to be connected to a power supply. The terminal mounting substrate with the terminals is bonded to the insulating sheet.

6 Claims, 9 Drawing Sheets

PLANAR HEATING DEVICE FOR USE WITH MIRRORS

This application is a divisional of U.S. patent application Ser. No. 08/567,772, filed Dec. 5, 1995 abandoned.

FIELD OF THE INVENTION

This invention relates to a planar heating device adapted to be affixed to, for example, the backside of a vehicle mirror, a bathroom mirror and the like for the purpose of defogging and/or defrosting.

BACKGROUND OF THE INVENTION

A typical prior art planar heating device adapted to be attached to the backside of the vehicle mirror is disclosed in U.S. Pat. No. 4,931,627 issued Jun. 5, 1990, for example. The conventional planar heating device of this type will be briefly described with reference to FIG. 1. A pair of main electrodes 3 and 4 in the form of a strip are printed on the back side of a flexible electrically insulating sheet 2 such as a polyester sheet along the upper and lower end edges thereof in opposing relation with each other. The flexible insulating sheet 2 has its external shape slightly smaller than that of a mirror to which the insulating sheet 2 is affixed. FIG. 1A is an illustration of the insulating sheet 2 as seen through from the front side thereof, assuming that the insulating sheet 2 is transparent. Extended electrically conductive paths 5 and 6 of the main electrodes 3 and 4 (hereinafter each referred to as conductive path) are formed so as to extend from one ends of the corresponding main electrodes 3 and 4 toward each other, respectively, and the distal ends thereof are used as terminal connecting portions 5*a* and 6*a*, respectively in opposing proximity with each other. Comb-toothed sub-electrodes 7 and 8 are formed by printing so as to extend from the corresponding main electrodes 3 and 4 and the conductive paths 5 and 6 into interdigitated relation. A layer 9 of electrically resistive material (hereinafter referred to as resistive layer or film) is formed to cover the sub-electrodes 7 and 8 as shown in FIG. 1B.

A pair of terminals 11, 12 are staked to the surface of the insulating sheet 2 at the respective terminal connecting portions 5*a* and 6*a* by means of eyelet pieces 13 so that the terminals 11 and 12 are electrically connected to the terminal connecting portions 5*a* and 6*a*, respectively. The terminals 11 and 12 are adapted to be connected to a power supply not shown. In many instances, the planar heating device 1 is completed with a double faced adhesive tape 15 applied to one side of the insulating sheet 2 having the resistive layer 9 formed thereon. When it is desired to stick the device to the mirror, a release paper 15*a* is peeled off the adhesive tape 15 prior to affixing the device to the mirror.

The resistive layer 9 will usually increase in its resistivity with an increase in temperature. Upon being supplied with electric power, the planar heating device 1 for use with a mirror is initially at a low temperature so that the resistive layer 9 is at a low level of resistivity to allow flow of a large amount of electric current. For this reason, the conductive paths 5, 6 and those portions of the main electrodes 3, 4 closer to the conductive paths are made wider to prevent burning. On the other hand, the main electrodes 3, 4 are tapered in width towards their distal ends as the current flow decreases.

With the construction of the conventional planar heating device 1, little heat is produced in the region of the main electrodes 3, 4 due to their greater width. Stated otherwise, the opposite edge portions where the main electrodes 3, 4 are mounted have a relatively large area where little heat is generated. On the other hand, the mirror having the planar heating device 1 attached thereto generally tends to have a substantial amount of heat dissipated from the outer periphery thereof, so that the temperature of the the peripheral edge portion of the mirror is lower than that of the central portion. This is aggravated at the peripheral edge portion, especially the edge portions opposing the main electrodes 3, 4 where little heat is produced.

In addition, the portion of the mirror overlying the conductive paths 5 and 6 is also lower in temperature than the rest because the conductive paths 5 and 6 have a broad width occupying a relatively large area where little heat is produced.

As is appreciated from the foregoing, the mirror to which the conventional planar heating device 1 was mounted produced little heat in the region overlying the main electrodes 3, 4 and the conductive paths 5 and 6 resulting in an uneven distribution of temperature over the mirror, so that there was a significant difference in the time required for defrosting and the like between the overlying regions and the rest.

Accordingly, it is an object of this invention to provide an improved planar heating device for use with a mirror wherein the heat producing area is expanded as close as possible to the outer periphery of the mirror such that the heat producing area covers substantially all of the surface of the mirror to realize a uniform distribution of temperature over the mirror, thereby reducing the unevenness in the time required for defrosting and the like depending on the location.

SUMMARY OF THE INVENTION

According to a first aspect of this invention, a terminal mounting substrate composed of flexible electrically insulating material is laminated by a layer of adhesive to one side surface of a flexible electrically insulating sheet on which main electrodes, comb-toothed sub-electrodes and a layer of resistive material are formed. A pair of electrically conductive paths in the form of a strip are formed on one side surface of the terminal mounting substrate facing the flexible insulating sheet. One ends of the conductive paths are connected with the corresponding main electrodes at their midpoints by electrode connecting means, respectively. Terminals are attached to the other side surface of the terminal mounting substrate opposite from the flexible insulating sheet at the other ends of the pair of conductive paths and are electrically connected with those conductive paths. The terminals are adapted to be connected to a power supply.

According to a second aspect of this invention, main electrodes, comb-toothed sub-electrodes and a layer of resistive material are formed on one side surface of a flexible insulating sheet, and terminals are attached to the other side surface of the flexible insulating sheet opposite from the one side surface thereof at center positions of the main electrodes intermediate their opposite ends and are electrically connected with the main electrodes. The terminals are adapted to be connected to a power supply.

BRIEF DESCRIPTION OF THE DRAWINGS

Other objects, features and advantages will be apparent from the following detailed description of preferred embodiments thereof taken in conjunction with the accompanying drawings in which:

FIG. 1 shows a prior art planar heating device for use with a vehicle mirror, wherein

FIG. 2 shows an embodiment according to a first aspect of this invention, wherein

FIG. 4 shows another embodiment according to the first aspect of this invention, wherein

FIG. 5 shows an embodiment according to a second aspect of this invention, wherein

FIG. 6 shows another embodiment according to the second aspect of this invention, wherein

FIG. 7 shows still another embodiment according to the second aspect of this invention, wherein

DESCRIPTION OF THE PREFERRED EMBODIMENTS

Figure 1A:
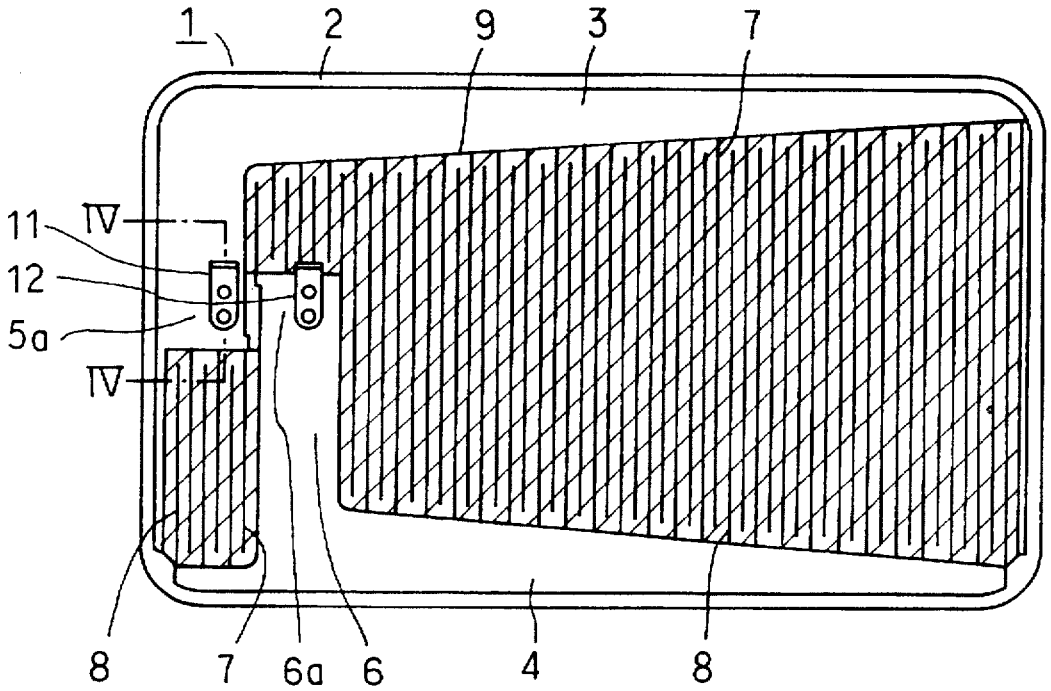
FIG. 1A PRIOR ART
FIG. 1A is a plan view of the device.
Figure 1B:
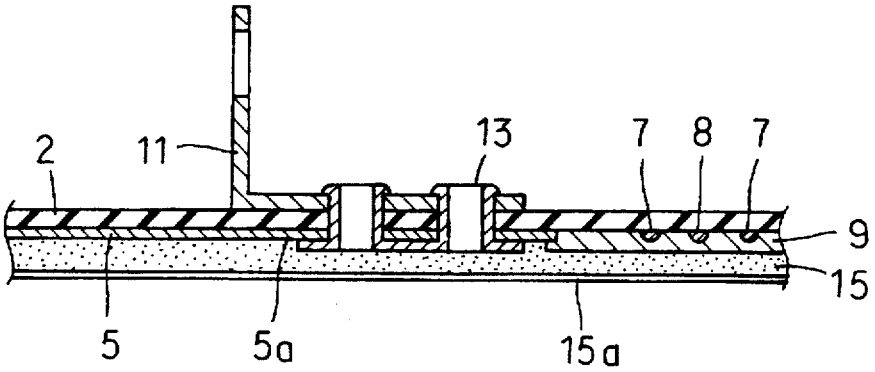
FIG. 1B PRIOR ART
FIG. 1B is an enlarged cross-sectional view taken on line IV—IV of FIG. 1B.
Figure 1C:
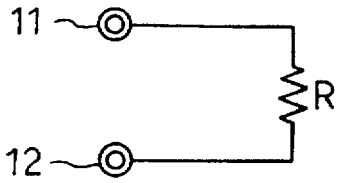
FIG. 1C PRIOR ART
FIG. 1C is a diagram of the electric circuit.
Figure 2A:
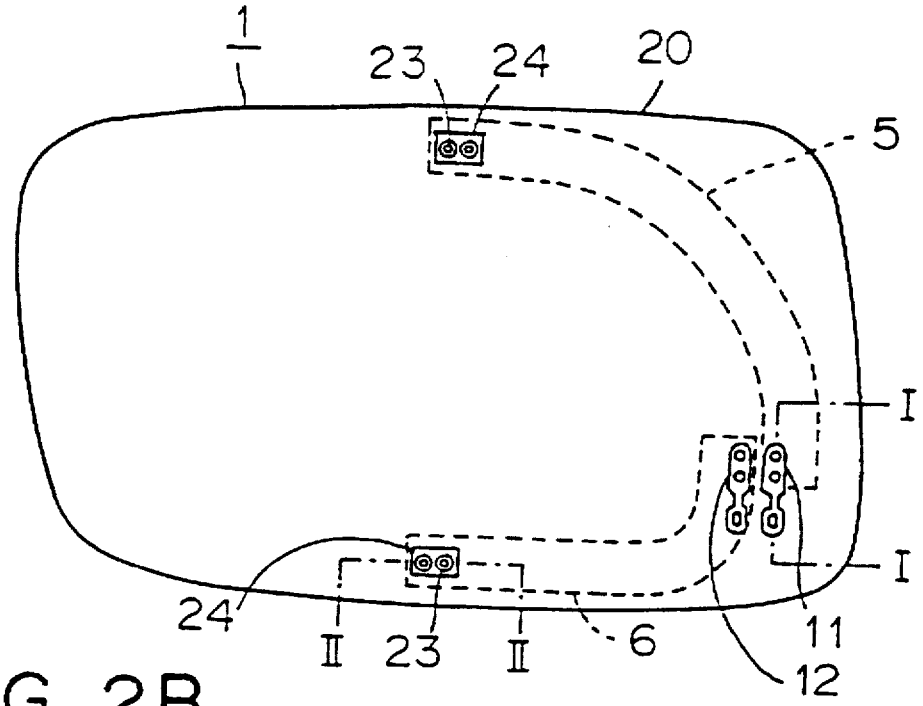
FIG. 2A is a plan view of the device.
Figure 2B:
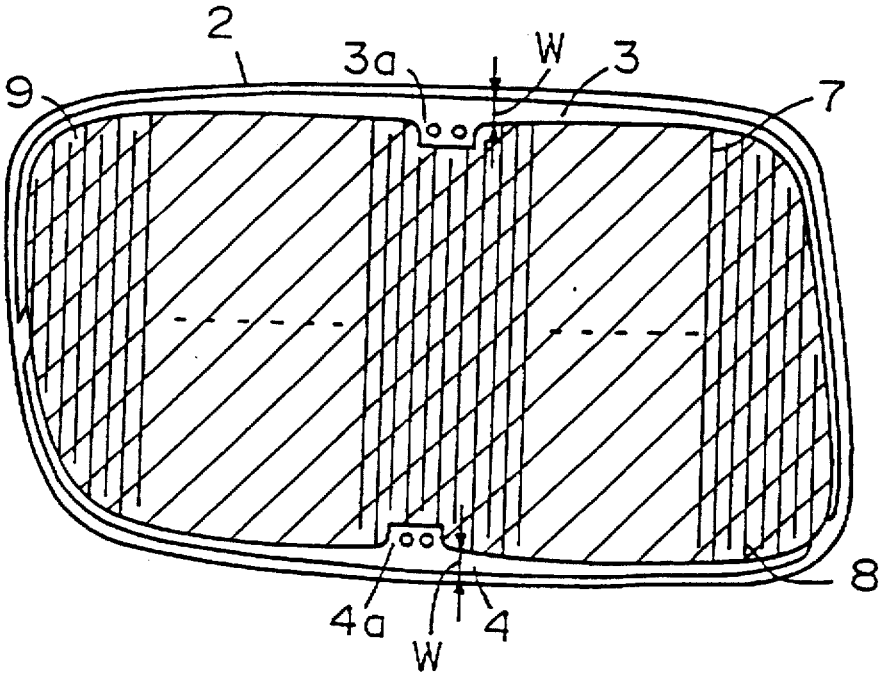
FIG. 2B is a plan view of the device having the terminal mounting substrate removed therefrom.
Figure 2C:
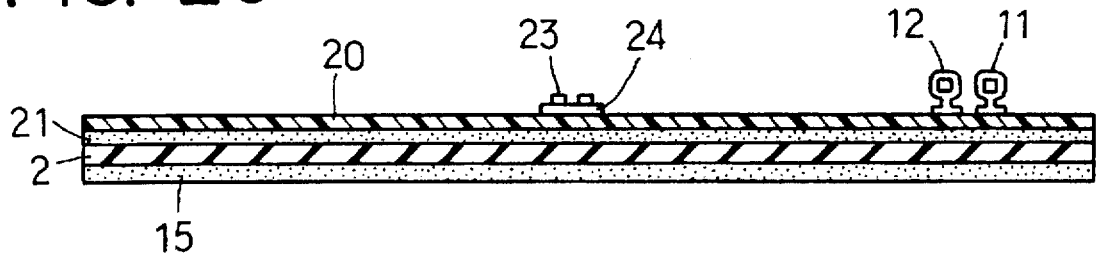
FIG. 2C is a front view.

Referring to FIGS. 2 and 3, there is shown an embodiment according to a first aspect of this invention, wherein the parts corresponding to those shown in FIG. 1 are indicated by like numerals. In the planar heating device 1 for the mirror application in this embodiment, a terminal mounting substrate 20 is laminated by means of a layer 21 of adhesive to one side surface of a flexible electrically insulating sheet 2 on which main electrodes 3, 4, comb-toothed sub-electrodes 7, 8 and a resistive layer 9 are formed.

As is conventional, the pair of main electrodes 3, 4 in the form of a strip are formed on one side surface of the flexible insulating sheet 2 along the periphery thereof in opposing relation with each other. Short junction electrode sections 3*a* and 4*a* extend toward each other inwardly from the respective main electrodes 3 and 4 generally at a midpoint of the electrodes intermediate their opposite ends. The comb-toothed sub-electrodes 7 and 8 are formed so as to extend from the corresponding main electrodes 3, 4 and the junction electrode sections 3*a* and 4*a* into interdigitated relation. The resistive layer 9 is formed on the one side surface of the flexible insulating sheet 2 to cover the sub-electrodes 7 and 8.

The main electrodes 3, 4 taper in width as they extend in opposite directions from the respective junction electrode sections 3*a*, 4*a* towards their opposite ends. The sub-electrodes 7, 8 are distributed generally uniformly over almost the entire surface of the flexible insulating sheet 2. The resistive layer 9 may comprise a resistive material in the form of a mixture consisting of carbon and resin, for example, whether it may have or may not have PTC (positive temperature coefficient). To the outer surface of the flexible insulating sheet 2 is affixed a double faced adhesive tape 15.

Figure 3A:
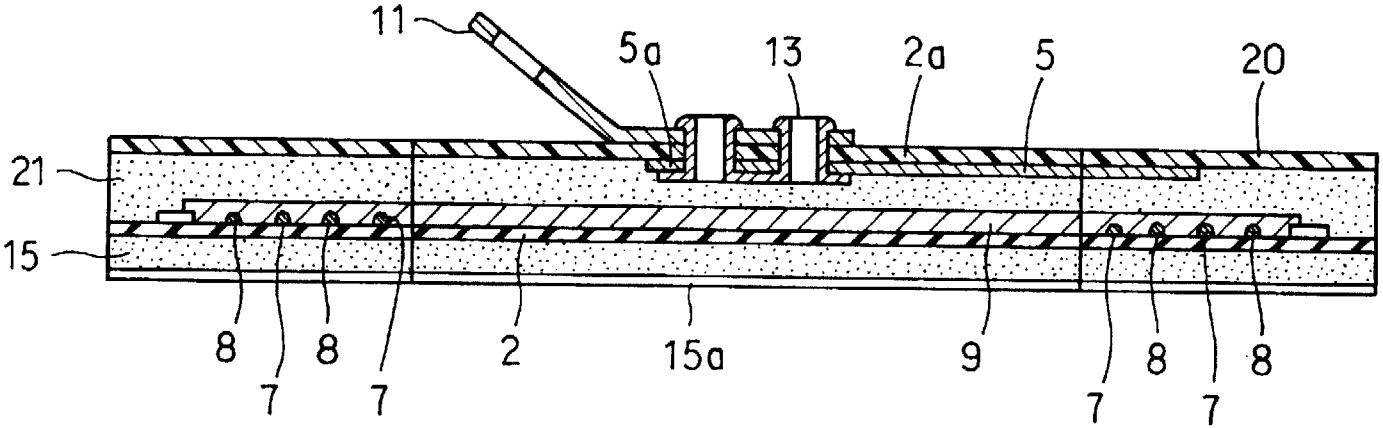
FIG. 3A is an enlarged cross-sectional view taken on line I—I of FIG. 2A.
Figure 3B:
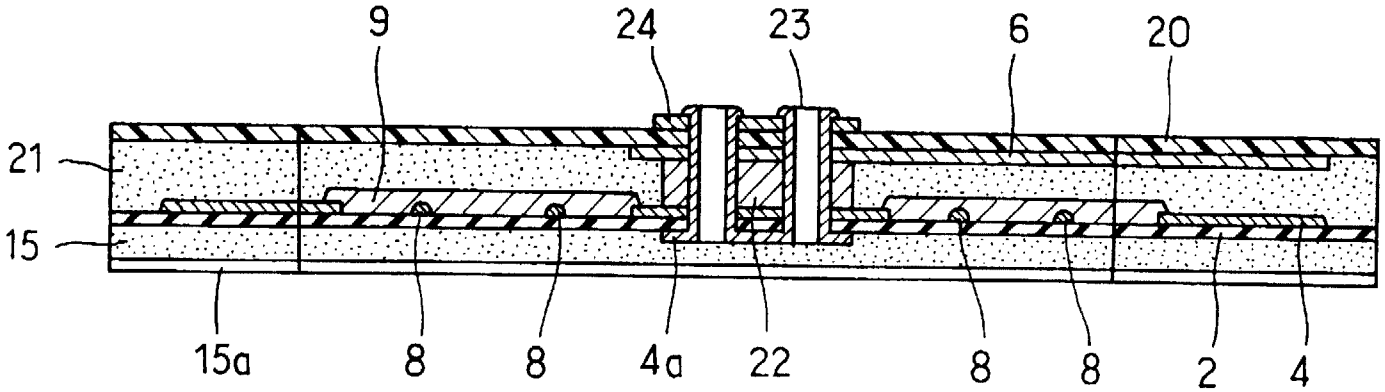
FIG. 3B is an enlarged cross-sectional view taken on line II—II of FIG. 2A.

The terminal mounting substrate 20 in this embodiment is sized to have substantially the same outer dimension as the flexible insulating sheet 2 and is formed of a flexible electrically insulating sheet such as a polyester sheet. As best seen in FIGS. 3A and 3B which are enlarged cross-sectional views of portions of FIG. 2A, respectively, a pair of electrically conductive paths 5 and 6 in the form of a strip are formed on one side surface of the terminal mounting substrate 20 facing the flexible insulating sheet 2. One ends of the conductive paths 5 and 6 are positioned to oppose and another and are connected with the corresponding junction electrode sections 3*a* and 4*a* by electrode connecting means while the other ends of the conductive paths 5 and 6 extend into proximity with each other adjacent a corner of the terminal mounting substrate 20. To the other ends of the conductive paths 5, 6 are connected terminals 11 and 12 which are secured to the surface of the terminal mounting substrate 20 opposite from the flexible insulating sheet 2. A voltage is applied between the terminals 11 and 12 from a power supply not shown.

Since the conductive paths 5 and 6 are disposed on the terminal mounting substrate 20, the present invention permits the regions of the flexible insulating sheet 2 where the conductive paths extended in the prior art to be utilized as an effective heat producing area, whereby the temperature distribution of the mirror to which the heating device is mounted is made more uniform.

In addition, the prior art required that the broadest portions of the main electrodes 3, 4 have substantially the same width as that of the conductive paths 5, 6, since the conductive paths were connected with one ends of the main electrodes so that the electric current from each of the conductive paths 5, 6 would flow into and through substantially the entirety of the associated main electrode 3, 4. In contrast, according to this invention, the extended electrodes 5, 6 are connected with the main electrodes 3, 4 at the middle point between their opposite ends, respectively, so that approximately half of the electric current flowing through each of the conductive paths 5, 6 will flow into each of the two oppositely extending half sections of each of the main electrodes 3, 4. Accordingly, the width W of the broadest portion of the main electrode 3, 4 need only be half of the width of the conductive paths 5, 6. It will thus be appreciated that the reduced width of the main electrodes 3, 4 as compared with the conventional ones permits the heat producing region to extend closer to the outer periphery of the mirror to thereby raise the temperature of the periphery.

In the embodiment illustrated in FIG. 3, the electrode connecting means for electrically connecting between the conductive paths 5, 6 and the main electrodes 3, 4 comprises electrically conductive washers (which are also termed electrically conductive spacers) 22 such as of copper interposed between the junction electrode sections 3*a*, 4*a* and the opposing end portions of the conductive paths 5, 6, respectively, and an eyelet piece 23 or a rivet which pinches or rivets the insulating sheet 2 and the terminal mounting substrate 20 together from the outsides thereof so that the insulating sheet 2 and the terminal mounting substrate 20 are fixed and the main electrode 3, 4 and the conductive paths 5, 6 are electrically connected together. In this case, retainer plates 24 may be placed on the outer surface of the terminal mounting substrate 20 such that the retainer plates 24 are secured together with the terminal mounting substrate 20 and the insulating sheet 2 by the eyelet piece 23 to provide the joint portion with an enhanced mechanical strength. The mounting of the terminals 11, 12 to the substrate 20 and their electrical connection with the conductive paths 5, 6 are performed in the similar manner as with the conventional heating device.

Figure 4A:
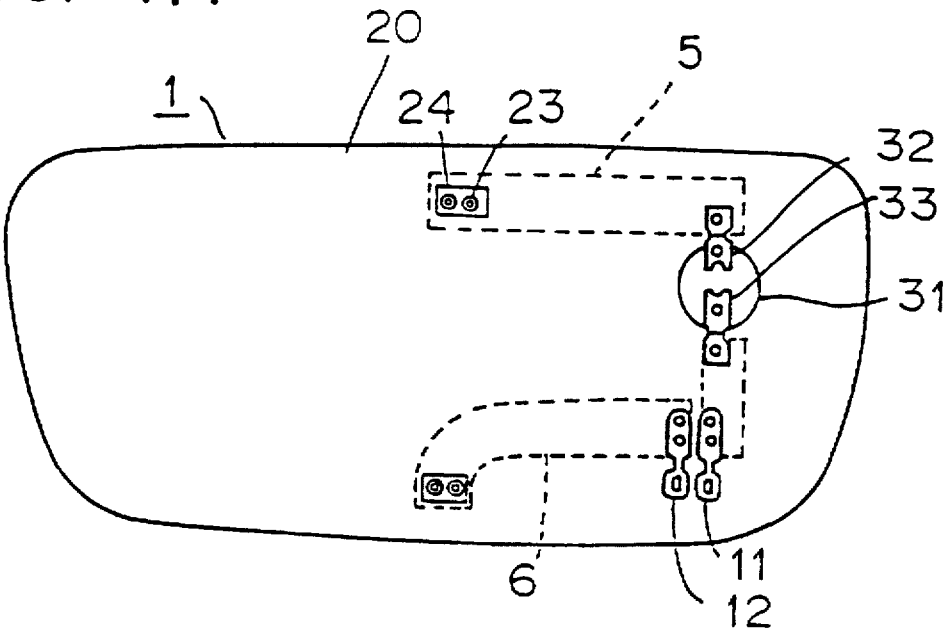
FIG. 4A is a plan view of the device.
Figure 4B:
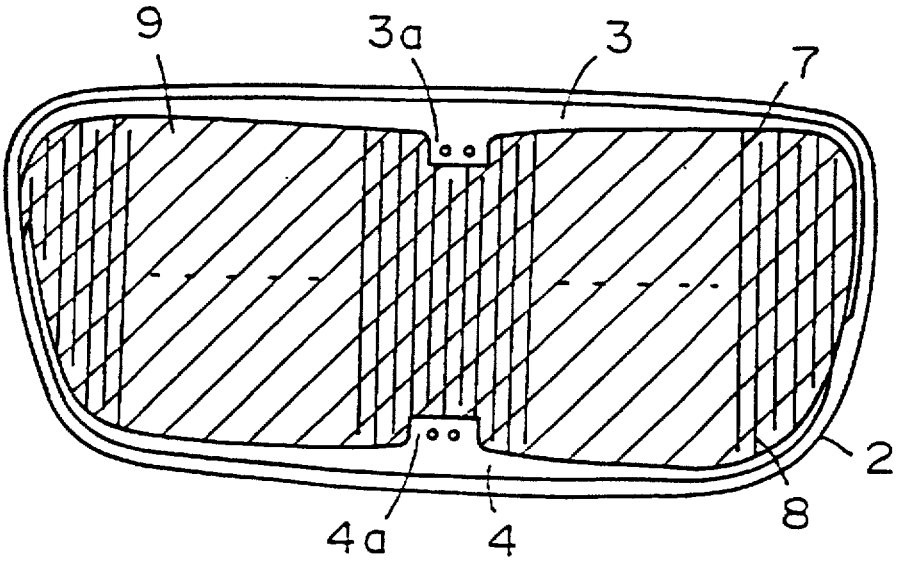
FIG. 4B is a plan view of the device having the terminal mounting substrate removed therefrom.
Figure 4C:
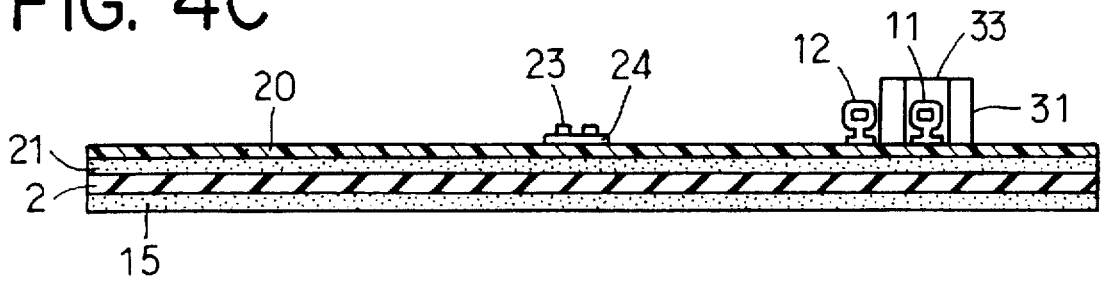
FIG. 4C is a front view.

FIG. 4 is an illustration of a modified embodiment in which a thermostat 31 is mounted to the outer surface of the terminal mounting substrate 20. Specifically, one of the conductive paths 5, 6, the conductive path 5 in the illustrated embodiment is made in two separate sections spaced from each other, and the thermostat 31 is disposed in the space between the two separate sections of the conductive path 5 and electrically connected at its opposite ends with adjacent ends of the two separate sections by suitable fittings 32 and 33 which also secure the thermostat 31 to the terminal mounting substrate 20.

The temperature of the planar heating device 1 for the mirror application may be kept down within predetermined limits by the thermostat 31 being switched on and off depending on the temperature. In this regard, it is to be understood that the thermostat 31 is located so as to overlie the heat producing region where the resistive film 9 is disposed so that it may be accurately switched on and off depending on the temperature of the heat producing region. If a thermostat 31 were interposed in the middle of either the conductive path 5 or 6 of the prior art device shown in FIG. 1, it would be difficult to maintain the planar heating device 1 and hence the mirror within a preset range of temperature, because the location where the thermostat was mounted would be at a temperature lower than the heat producing region and would be further cooled by heat dissipation through the thermostat.

While the conductive path 5 is split at a point intermediate its opposite ends in the illustrated embodiment, a thermostat 31 may be inserted between one end of the uninterrupted conductive path 5 and one end of the terminal 11 electrically in series and be attached to the outer surface of the terminal mounting substrate 20.

An embodiment according to a second aspect of this invention will now be described with reference to FIG. 5, wherein the parts corresponding to those shown in FIGS. 1 to 4 are indicated by like numerals. This embodiment is distinguished from those according to the first aspect of the present invention illustrated in FIGS. 2–4 in that the terminal mounting substrate 20 of FIGS. 2–4 is omitted, and that the terminals 11 and 12 are mounted to the junction electrode sections 3*a* and 4*a* formed on the flexible insulating sheet 2, respectively. That is, the terminals 11, 12 are attached to the surface of the flexible insulating sheet 2 opposite from the surface on which the junction electrode sections 3*a*, 4*a* are formed by means of an eyelet piece 13 or rivet so that they are electrically connected with the junction electrode sections 3*a*, 4*a*, respectively.

Figure 5A:
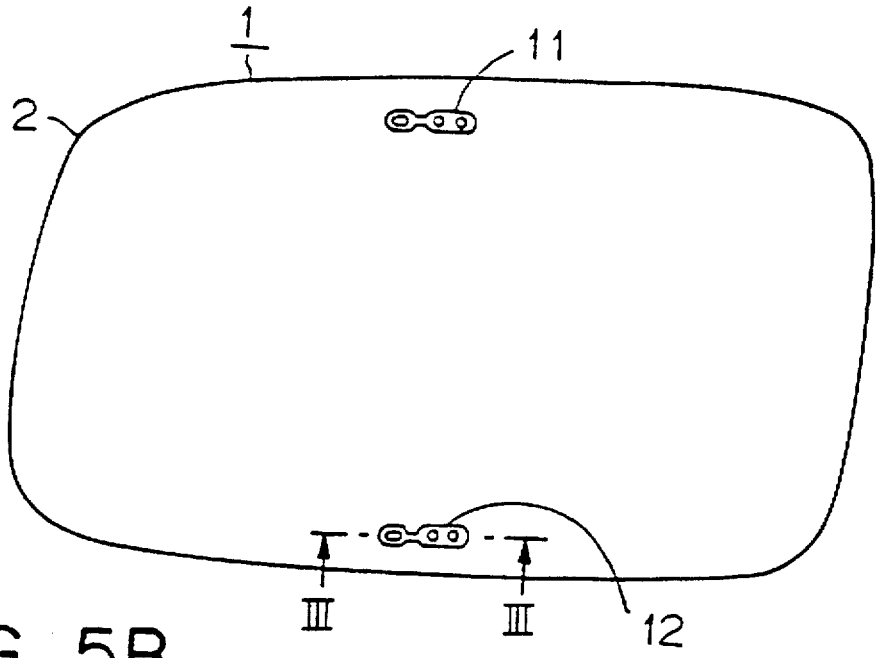
FIG. 5A is a plan view of the device.
Figure 5B:
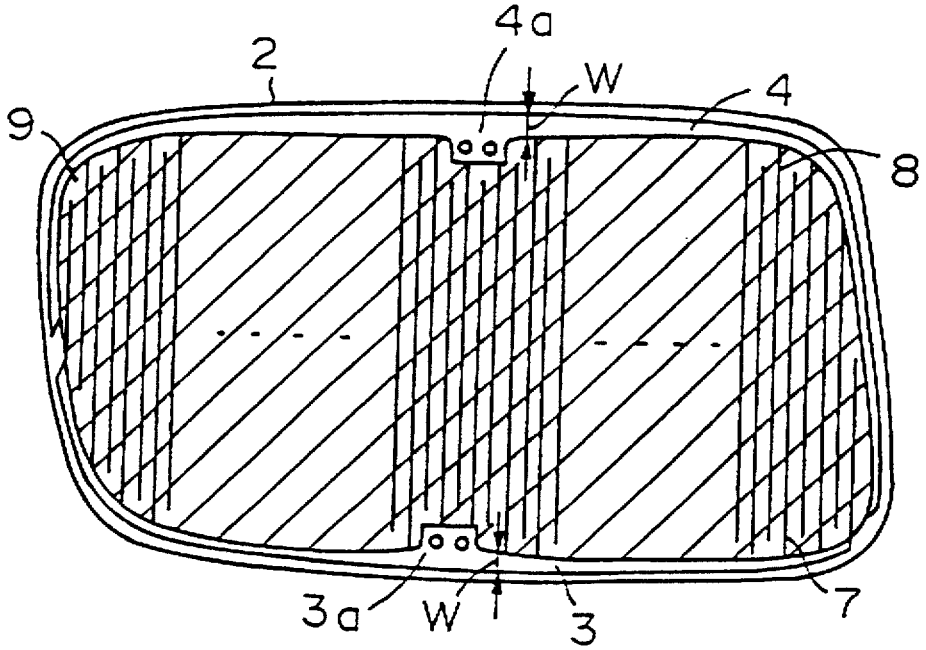
FIG. 5B is a bottom plan view of the insulating sheet.
Figure 6A:
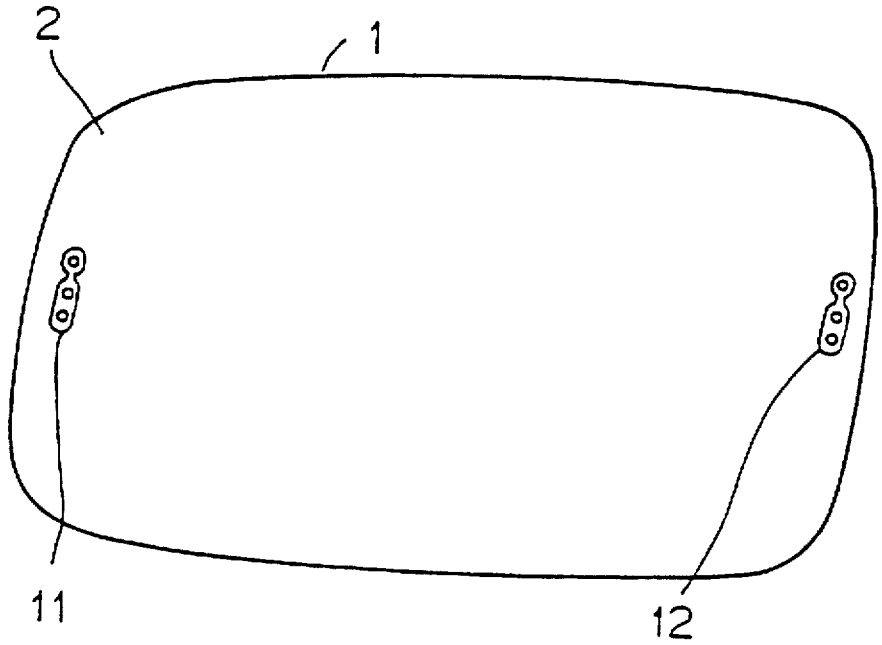
FIG. 6A is a plan view of the device.
Figure 6B:
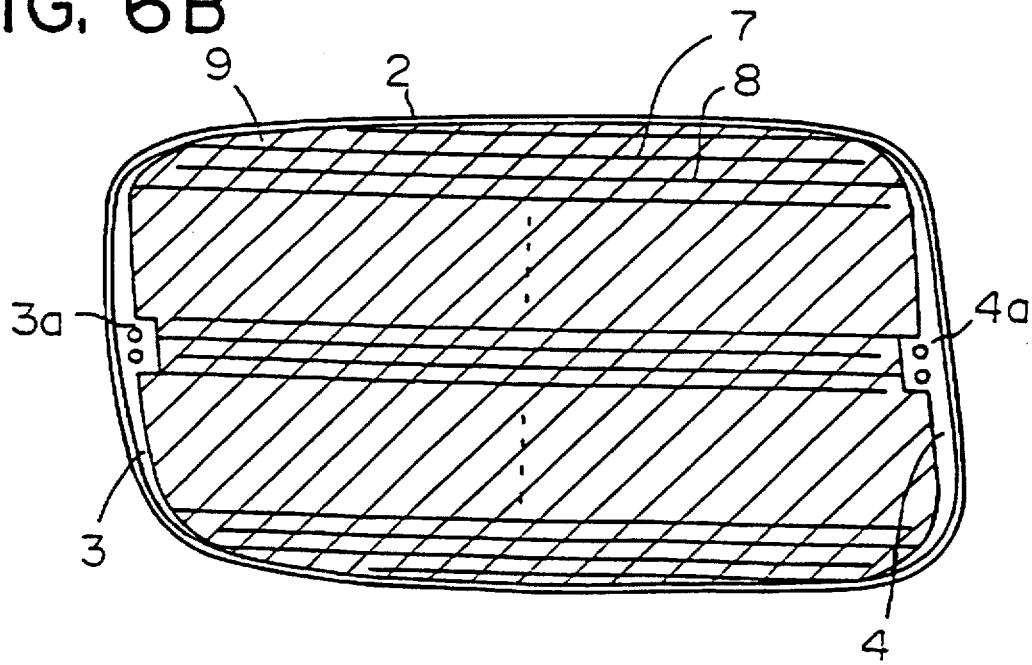
FIG. 6B is a bottom plan view of the insulating sheet.
Figure 5C:
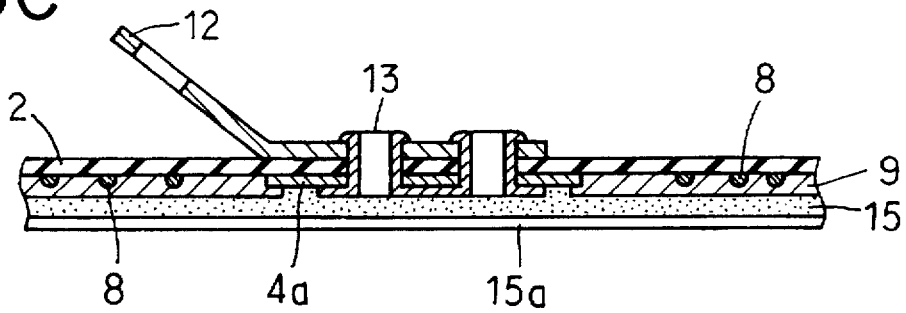
FIG. 5C is an enlarged cross-sectional view taken on line III—III of FIG. 5A.
Figure 6C:
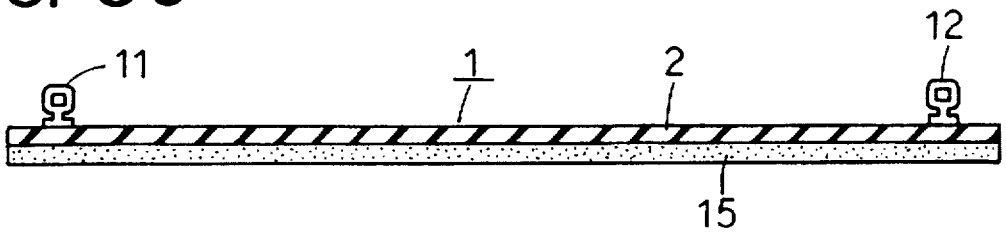
FIG. 6C is a front view.

In an alternative embodiment illustrated in FIG. 6, the main electrodes 3, 4 are formed on the insulating sheet 2 along the opposed left and right side transverse peripheral edges rather than the longitudinal edges. It is to be appreciated that this arrangement is applicable to not only the embodiment shown in FIG. 5, but also the embodiments shown in FIGS. 2 and 4.

Figure 7A:
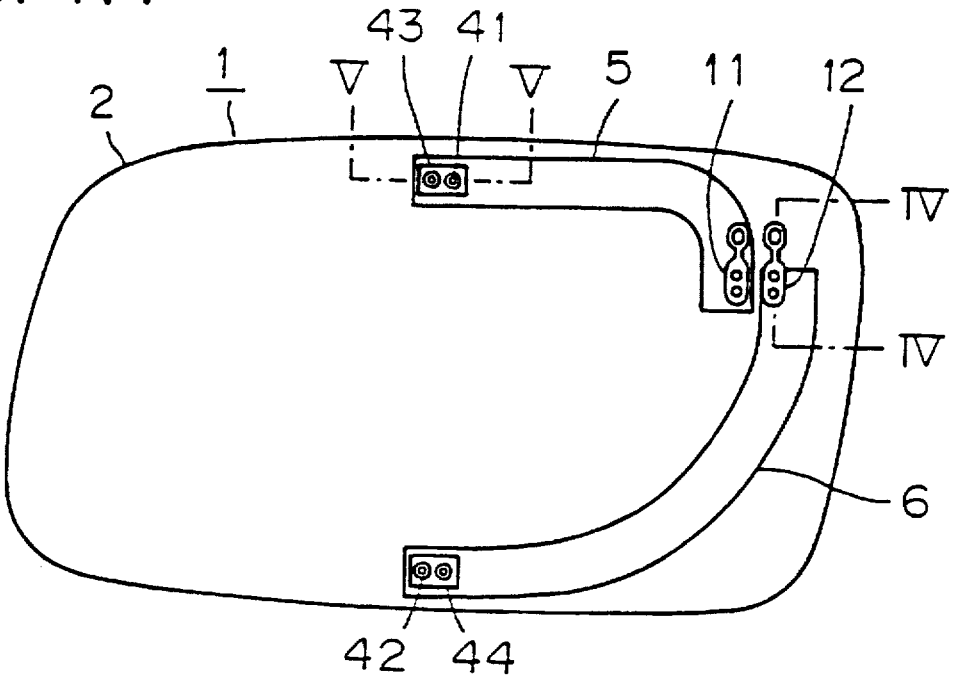
FIG. 7A is a plan view of the device having the double-faced adhesive tapes 15, 45 removed therefrom.
Figure 7B:
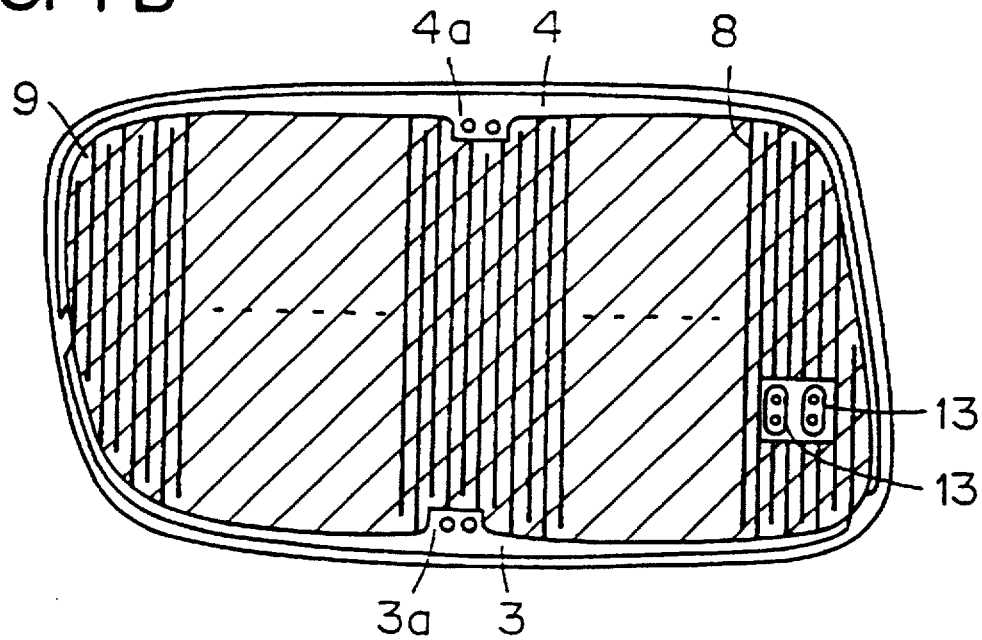
FIG. 7B is a bottom plan view of the device.
Figure 8A:
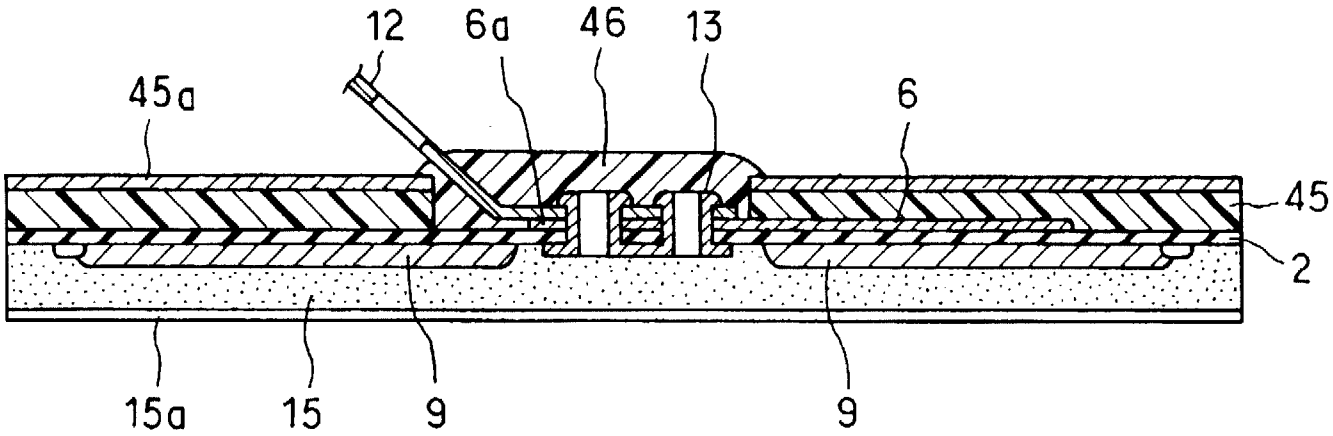
FIG. 8A is an enlarged cross-sectional view taken on line IV—IV of FIG. 7A.
Figure 8B:
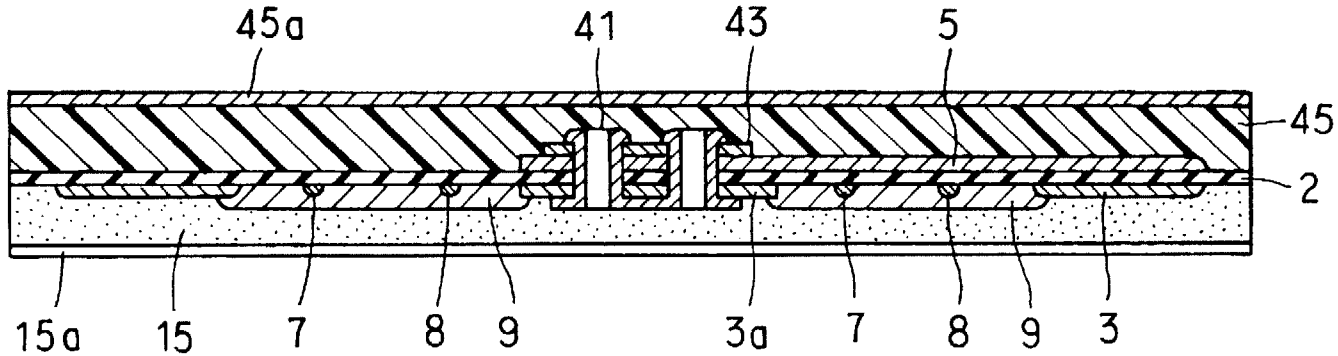
FIG. 8B is an enlarged cross-sectional view taken on line V—V of FIG. 7.
Figure 7C:
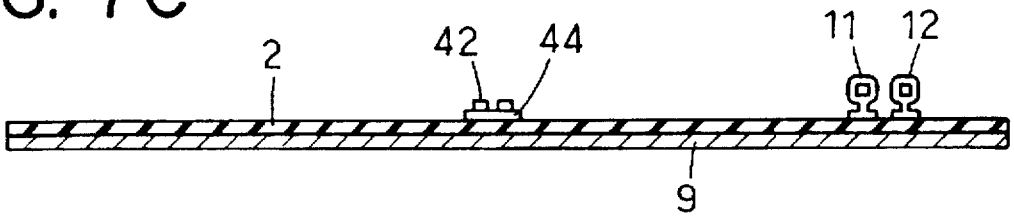
FIG. 7C is a front view.

FIGS. 7 and 8 show another embodiment according to the second aspect of this invention, wherein the parts corresponding to those shown in FIGS. 2, 3 and 5 are indicated by like numerals. In this embodiment, conductive paths 5, 6 similar to those shown in FIG. 2 are formed on the surface of the flexible insulating sheet 2 of FIG. 5 opposite from the surface on which a resistive layer 9 is formed. One ends of the conductive paths 5, 6 are positioned to face corresponding junction electrode sections 3*a*, 4*a*, respectively. The junction electrode section 3*a* and the one end of the conductive path 5 are secured and electrically connected together by an eyelet piece or rivet 41 which pinches or rivets them together from the outsides thereof. Likewise, the junction electrode section 4*a* and the one end of the conductive path 6 are secured and electrically connected together by an eyelet piece or rivet 42 which pinches or rivets them together from the outsides thereof. In order to reinforce these joint portions, electrically conductive washers 43, 44 may preferably be interposed between the junction electrode sections 3*a*, 4*a* and the one end portions of the conductive paths 5, 6, and be pressed by the eyelet pieces or rivets 41, 42 concurrently with the rivetting of the junction electrode sections 3*a*, 4*a* and the one ends of the conductive paths 5, 6, respectively.

The other ends of the conductive paths 5, 6 are positioned in proximity with each other and adjacent to one end of the insulating sheet 2. Terminals 11, 12 to be connected to a power supply are electrically connected with the other ends of the conductive paths 5, 6 and secured to the insulating sheet 2 by means of an eyelet piece or rivet 13.

In order to protect the conductive paths 5, 6 against the external environment, an electrically insulating layer such as a double faced adhesive tape 45 is affixed to the surface of the insulating sheet 2 on which the conductive paths 5, 6 are formed except for portions thereof to which the terminals 11, 12 are attached and their adjacent areas. In such case, it is preferable that portions of the double faced adhesive tape 45 corresponding to the portions of the surface of the insulating sheet 2 to which the terminals 11, 12 are attached are cut out prior to affixing it to the surface of the insulating sheet 2 and thereafter the adhesive tape 45 with the cutout portions is affixed to the surface of the insulating sheet 2. Usually, a release paper 45*a* on the outer surface of the adhesive tape 45 is not peeled off.

Further, an electrically insulating layer 46 such as a silicone rubber adhesive is formed on exposed portions of the surface of the insulating sheet 2 to which the terminals 11, 12 are attached for protection against the external environment. Since a silicone rubber adhesive takes a considerable time to dry, it is preferable that at first a double faced adhesive tape 45 with the cutout portions is affixed to the surface of the insulating sheet 2 on which the conductive paths 5, 6 are formed and thereafter a silicone rubber adhesive 46 is applied on the exposed portions of the surface of the insulating sheet 2 to which the terminals 11, 12 are attached. Other suitable electrically insulating adhesives may be used to cover the terminals 11, 12.

In the illustrated embodiment, a double faced adhesive tape 45 is used as an electrically insulating layer and affixed to the whole surface of the insulating sheet 2 on which the conductive paths 5, 6 are formed except for portions thereof to which the terminals 11, 12 are attached. Of course, electrically insulating materials other than a double faced adhesive tape may be used to cover the whole surface of the insulating sheet 2 except for portions thereof to which the terminals 11, 12 are attached or only the surfaces of the conductive paths 5, 6 and, if necessary, their adjacent areas.

However, use of a double faced adhesive tape results in the important advantage that it can be very easily affixed to the whole surface of the insulating sheet 2 on which the conductive paths 5, 6 are formed except for portions thereof to which the terminals 11, 12 are attached by previously cutting out portions thereof corresponding to the portions of the surface of the insulating sheet 2 to which the terminals 11, 12 are attached, and so its work efficiency is greatly improved and the working time can be considerably shortened as compared with use of other insulating materials. Moreover, since the exposed portions of the surface of the insulating sheet 2 to which the terminals 11, 12 are attached are very small, it suffices to merely apply a small amount of a silicone rubber adhesive 46 on each of the exposed portions of the surface of the insulating sheet 2 and the working of application of the silicone rubber adhesive 46 becomes easy, and therefore its work efficiency is also improved.

In addition, a double faced adhesive tape 15 is affixed to the outer surface of the insulating sheet 2 on which the resistive layer 9 is formed. The adhesive tape 15 also has a release paper 15*a* on the outer surface thereof which is peeled off prior to affixing the device to a mirror as described before.

According to the first aspect of this invention, the conductive paths 5, 6 are removed from the insulating sheet 2 to the terminal mounting substrate 20 so that the heat producing area is formed over substantially the entire surface of the flexible insulating sheet 2, whereby the unevenness in the distribution of temperature over the mirror may be reduced. In addition, connecting the conductive paths with the respective main electrodes at a midpoint thereof makes it possible to reduce the width of the main electrodes, so that the heat producing area may be expanded to the vicinity of the outer periphery of the mirror where a great deal of heat dissipation occurs.

According to the second aspect of this invention, the terminal mounting substrate is eliminated and the terminals to be connected to a power supply are connected directly with the main electrodes, whereby substantially the same advantageous functional effects as the first aspect of the invention may be produced, and yet the cost of manufacture may be reduced.

Having thus described our invention, we claim:

1. A planar heating device for use with a mirror comprising:

a flexible electrically insulating sheet;

a first main electrode and a second main electrode formed on one side surface of said insulating sheet along opposed edge portions thereof, respectively;

a plurality of first comb-toothed sub-electrodes and a plurality of second comb-toothed sub-electrodes formed on the one side surface of said insulating sheet and having one ends connected with said first and second main electrodes, respectively, said first and second comb-toothed sub-electrodes extending into interdigitated relation;

a layer of electrically resistive material formed on the one side surface of said insulating sheet over said first and second sub-electrodes;

a terminal mounting substrate affixed to the one side surface of said insulating sheet over said layer of resistive material, said terminal mounting substrate being made of a flexible electrically insulating sheet;

a first electrically conductive path and a second electrically conductive path formed on the inner surface of said terminal mounting substrate opposing said insulating sheet, said first and second electrically conductive paths facing said layer of resistive material and having one ends in opposing relation with said first and second main electrodes;

first and second electrode connecting means for electrically connecting said one ends of said first and second electrically conductive paths with said first and second main electrodes, said first and second conductive paths being connected with said first and second main electrodes at midpoints of the first and second main electrodes between their opposite ends, respectively;

said first and second electrode connecting means comprising first and second junction electrode sections formed on the one side surface of said insulating sheet and connected with said corresponding first and second main electrodes, electrically conductive washer means interposed between said first and second junction electrode sections and the one ends of said first and second corresponding conductive paths, and first and second eyelet means for urging said first and second junction electrode sections and the one ends of said corresponding first and second conductive paths against said conductive washer means sandwiched therebetween by pressing said insulating sheet and said terminal mounting substrate from the outsides thereof; and a first terminal and a second terminal attached to the outer surface of said terminal mounting substrate at the other ends of said first and second electrically conductive paths and electrically connected with said first and second electrically conductive paths, respectively, said first and second terminals being adapted to be connected with a power supply.

2. The planar heating device according to claim 1 wherein the other ends of said first and second conductive paths are in opposing proximity with each other.

3. The planar heating device according to claim 2 wherein a thermostat is electrically connected in series between one end of one of said first and second conductive paths and the corresponding terminal, and is attached to said terminal mounting substrate and located so as to overlie said layer of resistive material.

4. The planar heating device according to claim 3 wherein said one of said first and second conductive paths is separated in two sections intermediate its opposite ends, and said two sections are electrically connected together at their adjacent ends through said thermostat.

5. The planar heating device according to claim 4 wherein a double faced adhesive tape is affixed to the surface of the insulating sheet on which said layer of resistive material is formed.

6. The planar heating device according to claim 1 wherein a double faced adhesive tape is affixed to the one side surface of said insulating sheet on which said layer of resistive material is formed.

* * * * *